US008668520B2

(12) United States Patent
Hsu et al.

(10) Patent No.: US 8,668,520 B2
(45) Date of Patent: Mar. 11, 2014

(54) CARD CONNECTOR HAVING A HOUSING WITH FASTENING BLOCKS FOR MOUNTING A CIRCUIT BOARD

(75) Inventors: Ya-Hui Hsu, New Taipei (TW); Ta-Chih Yu, New Taipei (TW)

(73) Assignee: Proconn Technology Co., Ltd., New Taipei (TW)

( * ) Notice: Subject to any disclaimer, the term of this patent is extended or adjusted under 35 U.S.C. 154(b) by 45 days.

(21) Appl. No.: 13/572,819

(22) Filed: Aug. 13, 2012

(65) Prior Publication Data

US 2014/0045376 A1 Feb. 13, 2014

(51) Int. Cl.
*H01R 13/60* (2006.01)

(52) U.S. Cl.
USPC ..... 439/567

(58) Field of Classification Search
USPC ..... 439/567–570, 352–358, 607.28
See application file for complete search history.

(56) References Cited

U.S. PATENT DOCUMENTS

| | | | | |
|---|---|---|---|---|
| 6,315,620 | B1 * | 11/2001 | Moir et al. | 439/862 |
| 7,074,085 | B2 * | 7/2006 | Chen | 439/607.36 |
| 7,467,956 | B2 * | 12/2008 | Hirai et al. | 439/83 |
| 7,566,242 | B2 * | 7/2009 | Zhu et al. | 439/567 |
| 7,997,932 | B2 * | 8/2011 | Xu | 439/607.04 |
| 8,033,861 | B2 * | 10/2011 | Zhu | 439/567 |
| 2002/0042224 | A1 * | 4/2002 | Fan | 439/570 |
| 2004/0203281 | A1 * | 10/2004 | Crane et al. | 439/569 |

* cited by examiner

*Primary Examiner* — Chandrika Prasad

(57) ABSTRACT

A card connector is adapted for being mounted to a circuit board defining a mounting cavity. The card connector includes an insulating housing defining a receiving room passing through a top and a front thereof, a plurality of electrical terminals disposed in the insulating housing and electrically projecting upward into the receiving room, a shielding shell enclosing the insulating housing, and a plurality of fastening blocks. A pair of side walls is formed at two opposite sides of the receiving room. The fastening blocks are apart secured to outsides of the side walls. The card connector is mounted in the mounting cavity of the circuit board, and the fastening blocks are fixed on the circuit board around the mounting cavity. Because the fastening blocks are not easily deformed, the card connector can be firmly fixed in the circuit board and avoids being slanted downward in use.

4 Claims, 2 Drawing Sheets

CARD CONNECTOR HAVING A HOUSING WITH FASTENING BLOCKS FOR MOUNTING A CIRCUIT BOARD

BACKGROUND OF THE INVENTION

1. Field of the Invention

The present invention relates to a card connector, and more particularly to a card connector adapted for being embedded in a circuit board.

2. The Related Art

With the development of electronic technology, the trend in connector design is towards miniaturization and thin profile, and a card connector adapted for being embedded in a circuit board comes with the tide of fashion. The card connector generally includes an insulating housing, a plurality of electrical terminals disposed in the insulating housing, and a shielding shell enclosing the insulating housing. Each of the electrical terminals has a soldering tail projecting behind the insulating housing. The shielding shell has two side plates die-cut and then oppositely bent outward to form a plurality of soldering feet. The circuit board defines a mounting cavity for mounting the card connector therein. The soldering tails of the electrical terminals and the soldering feet of the shielding shell are located in the same plane to be soldered on the circuit board around the mounting cavity. However, in use, due to easy deformation of the soldering tails and the soldering feet, the force of inserting and extracting an electronic card into and out of the card connector is apt to slant the card connector upward or downward with respect to the circuit board. As a result, the card connector easily looses relative to the circuit board.

SUMMARY OF THE INVENTION

Accordingly, an object of the present invention is to provide a card connector adapted for being mounted to a circuit board which defines a mounting cavity. The card connector includes an insulating housing, a plurality of electrical terminals, a shielding shell and a plurality of fastening blocks. The insulating housing defines a receiving room passing through a top and a front thereof. A pair of side walls is formed at two opposite sides of the receiving room. The electrical terminals are disposed in the insulating housing and electrically project upward into the receiving room. The shielding shell encloses the insulating housing. The fastening blocks are apart secured to outsides of the side walls of the insulating housing. The card connector is mounted in the mounting cavity of the circuit board, and the fastening blocks are fixed on the circuit board around the mounting cavity.

As described above, the card connector of the present invention utilizes the fastening blocks apart secured to the outsides of the side walls of the insulating housing to fasten the card connector in the circuit board. Because the fastening blocks are not easily deformed, the card connector can be firmly fixed in the circuit board and avoids being slanted downward in use. It further improves a use stability of the card connector.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
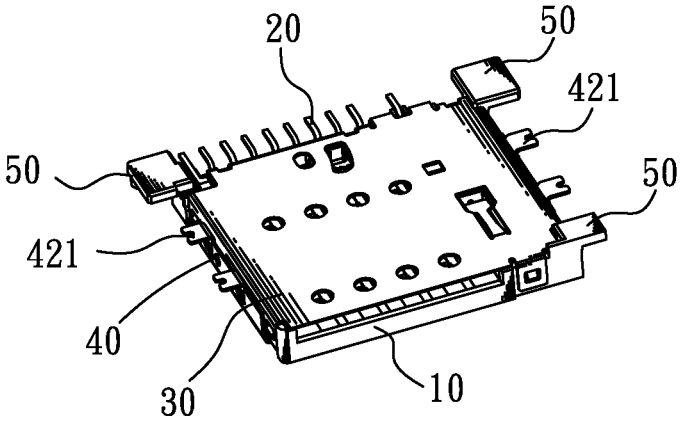
FIG. 1 is an assembled perspective view of a card connector according to an embodiment of the present invention.
Figure 2:
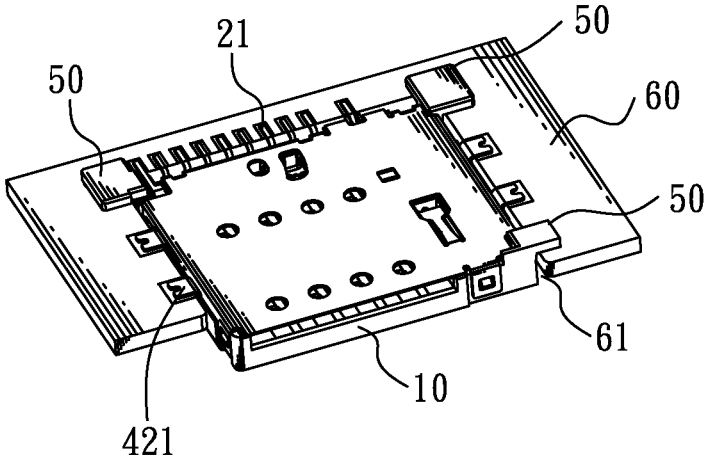
FIG. 2 is a perspective view showing that the card connector of FIG. 1 is mounted to a circuit board.

With reference to FIG. 1 and FIG. 2, a card connector according to an embodiment of the present invention is adapted for being mounted to a circuit board 60. The card connector includes an insulating housing 10, a plurality of electrical terminals 20, a shielding shell and a plurality of fastening blocks 50.

Figure 3:
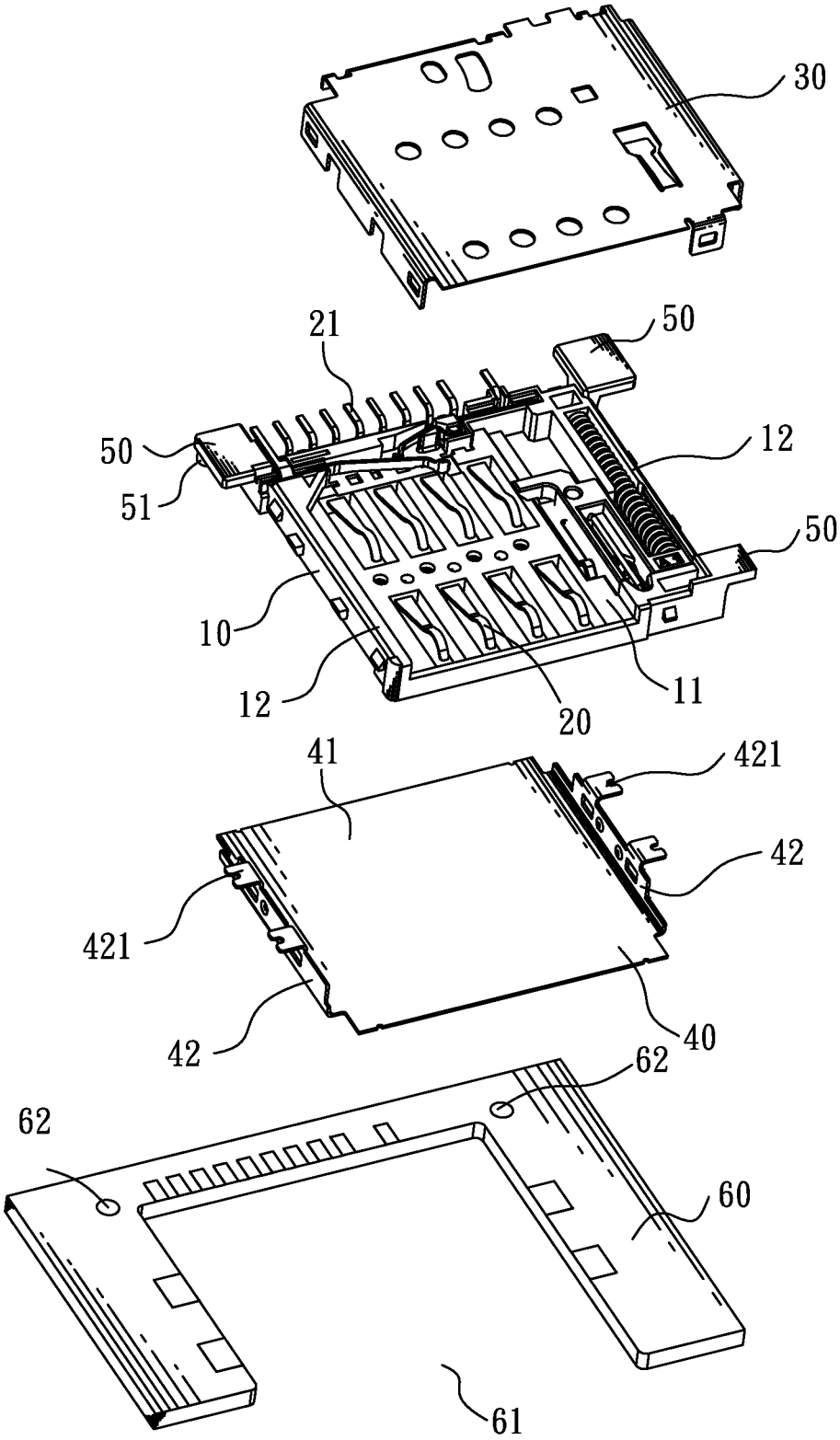
FIG. 3 is an exploded perspective view of the card connector and the circuit board of FIG. 2.

Referring to FIG. 2 and FIG. 3, the insulating housing 10 defines a receiving room 11 passing through a top and a front thereof. A pair of side walls 12 is formed at two opposite sides of the receiving room 11. The electrical terminals 20 are disposed in the insulating housing 10 and electrically project upward into the receiving room 11. The shielding shell encloses the insulating housing 10. The fastening blocks 50 are apart secured to outsides of the side walls 12 of the insulating housing 10. The circuit board 60 defines a mounting cavity 61. The card connector is mounted in the mounting cavity 61 of the circuit board 60, and the fastening blocks 50 are fixed on the circuit board 60 around the mounting cavity 61.

Referring to FIGS. 2 and 3 again, front and rear ends of top edges of the side walls 12 of the insulating housing 10 oppositely and horizontally protrude outward to form the fastening blocks 50. Two of the fastening blocks 50 formed at the rear ends of the side walls 12 further horizontally extend rearward to project beyond a rear side of the insulating housing 10. Bottom faces of the two fastening blocks 50 formed at the rear ends of the side walls 12 protrude downward to form a positioning block 51 respectively. Accordingly, a pair of positioning holes 62 is opened in the circuit board 60 for positioning the corresponding positioning blocks 51 therein.

Referring to FIGS. 1-3, each of the electrical terminals 20 has a soldering tail 21 projecting behind the insulating housing 10. The shielding shell includes an upper shielding shell 30 covered downward on the insulating housing 10 and a lower shielding shell 40 covered upward under the insulating housing 10. The lower shielding shell 40 has a bottom plate 41 and a pair of lateral plates 42 extending upward from two opposite side edges of the bottom plate 41. Top edges of the lateral plates 42 oppositely bend outward to form a plurality of soldering feet 421. The soldering feet 421 of the shielding shell and the soldering tails 21 of the electrical terminals 20 are located in the same plane to be soldered on the circuit board 60 around the mounting cavity 61.

As described above, the card connector of the present invention utilizes the fastening blocks 50 apart secured to the outsides of the side walls 12 of the insulating housing 10 to fasten the card connector in the circuit board 60. Because the fastening blocks 50 are not easily deformed, the card connector can be firmly fixed in the circuit board 60 and avoids being slanted downward in use. It further improves a use stability of the card connector.

What is claimed is:

1. A card connector adapted for being mounted to a circuit board which defines a mounting cavity, comprising:

an insulating housing defining a receiving room passing through a top and a front thereof, a pair of side walls being formed at two opposite sides of the receiving room;

a plurality of electrical terminals disposed in the insulating housing and electrically projecting upward into the receiving room;

a shielding shell enclosing the insulating housing; and a plurality of fastening blocks apart secured to outsides of the side walls of the insulating housing, the card connector being mounted in the mounting cavity of the circuit board, and the fastening blocks being fixed on the circuit board around the mounting cavity.

2. The card connector as claimed in claim 1, wherein front and rear ends of top edges of the side walls of the insulating housing oppositely and horizontally protrude outward to form the fastening blocks, bottom faces of two of the fastening blocks formed at the rear ends of the side walls protrude downward to form a positioning block respectively, accordingly, a pair of positioning holes is opened in the circuit board for positioning the corresponding positioning blocks therein.

3. The card connector as claimed in claim 2, wherein the two fastening blocks formed at the rear ends of the side walls further horizontally extend rearward to project beyond a rear side of the insulating housing.

4. The card connector as claimed in claim 1, wherein each of the electrical terminals has a soldering tail projecting behind the insulating housing, the shielding shell includes an upper shielding shell covered downward on the insulating housing and a lower shielding shell covered upward under the insulating housing, the lower shielding shell has a bottom plate and a pair of lateral plates extending upward from two opposite side edges of the bottom plate, top edges of the lateral plates oppositely bend outward to form a plurality of soldering feet, the soldering feet of the shielding shell and the soldering tails of the electrical terminals are located in the same plane to be soldered on the circuit board around the mounting cavity.

* * * * *